US006468055B1

(12) United States Patent
Purcell et al.

(10) Patent No.: US 6,468,055 B1
(45) Date of Patent: Oct. 22, 2002

(54) FUEL PUMP AND FILTER ASSEMBLY FOR AN ENGINE

(75) Inventors: John J. Purcell, Marlow (GB); Peter Leach, Darlington (GB)

(73) Assignees: Cummins Engine Company Ltd., Darlington (GB); Iveco (UK) Ltd., Watford (GB); New Holland U.K. Ltd., Basildon (GB)

( * ) Notice: Subject to any disclaimer, the term of this patent is extended or adjusted under 35 U.S.C. 154(b) by 0 days.

(21) Appl. No.: 09/343,061

(22) Filed: Jun. 29, 1999

(30) Foreign Application Priority Data

Jun. 30, 1998 (GB) ..... 9814084

(51) Int. Cl.[7] ..... F04B 3/00; F04B 23/00; F04B 17/00; B10D 24/00; F02M 37/04

(52) U.S. Cl. ..... 417/364; 417/244; 417/313; 210/416.4; 123/509; 123/510

(58) Field of Search ..... 417/313, 364, 417/244; 210/416.1, 171, 416.4; 123/509, 510

(56) References Cited

U.S. PATENT DOCUMENTS

| | | | | | |
|---|---|---|---|---|---|
| 1,799,771 A | | 4/1931 | Wheeler | 417/364 |
| 2,281,302 A | | 4/1942 | Amery | 103/220 |
| 2,882,884 A | * | 4/1959 | Scheiterlein | 123/373 |
| 3,294,240 A | * | 12/1966 | Korte | 210/181 |
| 3,575,296 A | | 4/1971 | Peterson | 210/416 |
| 3,964,459 A | * | 6/1976 | Kimberley | 123/140 FG |
| 4,711,616 A | * | 12/1987 | Tsukahara et al. | 417/216 |
| 5,231,967 A | | 8/1993 | Baltz | 123/497 |
| 5,362,392 A | | 11/1994 | Jensen | 210/249 |
| 5,507,266 A | * | 4/1996 | Wright et al. | 123/497 |
| 5,534,161 A | | 7/1996 | Tarr | 210/744 |

* cited by examiner

*Primary Examiner*—Charles G. Freay
*Assistant Examiner*—Timothy P. Solak
(74) *Attorney, Agent, or Firm*—Gary M. Gron

(57) ABSTRACT

The invention relates to an apparatus comprising a pump unit 22 incorporating an engine driven low pressure pump for drawing fuel from a reservoir and an engine driven high pressure pump connected to supply fuel drawn by the low pressure fuel pump under pressure to a common fuel rail 18. The assembly also includes fuel filter 48 connected in the fuel flow path between the low pressure and the high pressure pump. The fuel filter comprises a fuel filter head 30 mounted directly on, or formed integrally with, the housing of the pump unit 22. The filter head 30 includes a plate **30*b* for mounting a filter housing 48** containing a filter element, and is formed with a first internal flow passage to enable fuel pressurised by the low pressure pump to be supplied to one side of the filter element and a second flow passage connected to the other side of the filter element to enable the filtered fuel to be supplied to the high pressure pump.

5 Claims, 2 Drawing Sheets

FUEL PUMP AND FILTER ASSEMBLY FOR AN ENGINE

FIELD OF THE INVENTION

The present invention relates to a fuel pump and filter assembly for an engine, in particular a compression ignition (diesel) engine.

BACKGROUND OF THE INVENTION

In a diesel engine operating with a high pressure common rail (HPCR) fuel system, a low pressure supply pump draws fuel from the fuel tank and supplies it to a high pressure pump that pressurises the common fuel rail. It is not desirable to place the fuel filter on the suction side of the low pressure pump because low pressure supply pumps, such as gear, gerotor and vane pumps, are not capable of generating high suction without the risk of cavitation. Consequently, the fuel filter is normally positioned between the low pressure supply pump and the high pressure pump.

In an HPCR pump in which the low pressure supply pump is incorporated within the same unit as the high pressure pump, the filter is positioned remotely and fuel lines are needed to route the fuel from the outlet of the low pressure pump to the fuel filter and then back from the filter to the inlet of the high pressure pump. These lines, or tubing, make for high assembly and component costs. In certain applications, for example in an agricultural vehicle, exposed tubes also risk being hit by objects in the field, thereby incurring greater maintenance costs.

OBJECT OF THE INVENTION

The present invention aims to mitigate the foregoing disadvantages by reducing the external pipework required to connect the low and high pressure pumps to one another through a fuel filter.

SUMMARY OF THE INVENTION

According to the present invention, there is provided an assembly comprising a pump unit incorporating an engine driven low pressure pump for drawing fuel from a reservoir and an engine driven high pressure pump connected to supply fuel drawn by the low pressure fuel pump under pressure to a common fuel rail, and fuel filtering means connected in the fuel flow path between the low pressure and the high pressure pump, characterised in that the fuel filtering means comprises a fuel filter head connected directly to, the housing of the pump unit and including a plate for mounting a filter containing a filtration element, the fuel filter head being formed with a first internal flow passage to enable fuel pressurised by the low pressure pump to be supplied to one side of the filter element and a second flow passage connected to the other side of the filter element to enable the filtered fuel to be supplied to the high pressure pump.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
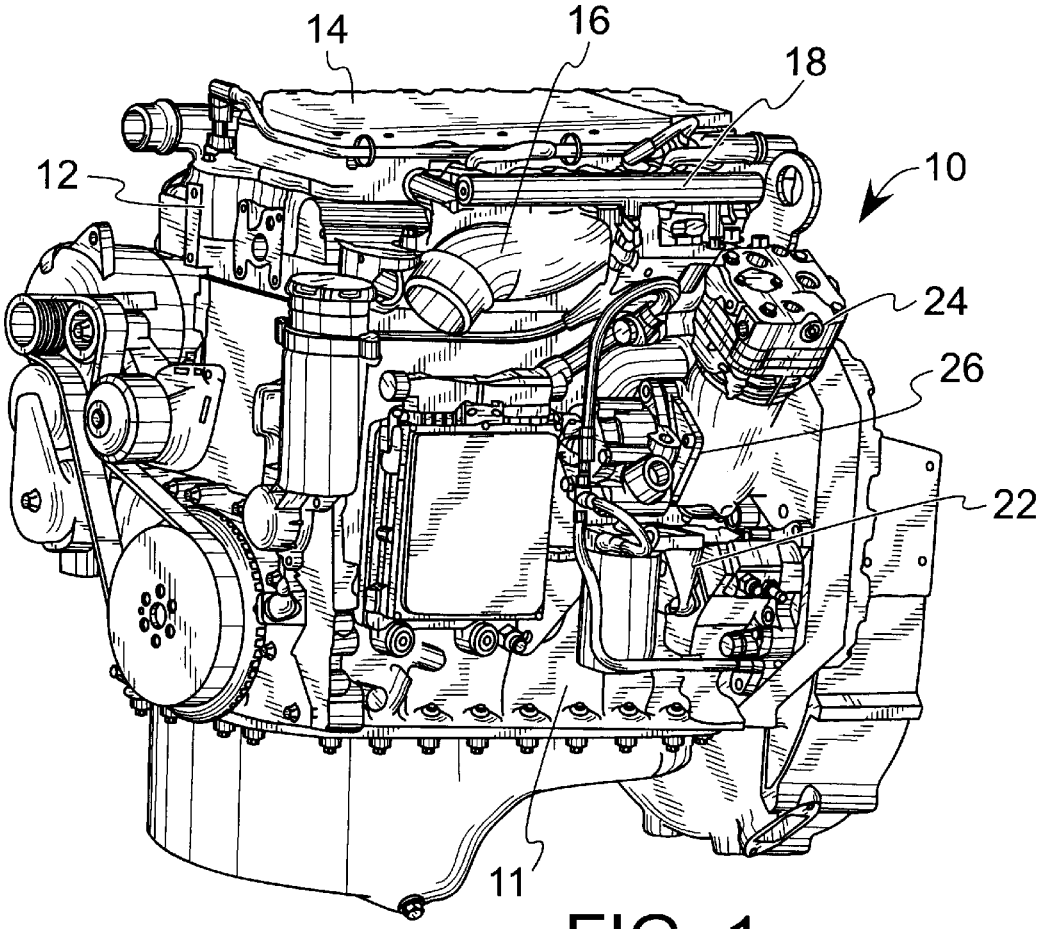
FIG. 1 is a perspective view of an engine fitted with an HPCR pump unit.

FIG. 1 shows an in-line reciprocating diesel engine 10 operating with a high pressure common rail (HPCR) fuel system as described below. Most of the internal parts of the engine such as the crankshaft, pistons, connecting rod etc. are well known to those skilled in the art and therefore will not be described in detail. The engine is a push rod engine that comprises an engine block 11, a cylinder head 12 and a rocker cover 14. An intake manifold 16 supplies air to the engine cylinders and a common fuel rail 18 connected to injectors (not shown) supplies fuel for combustion. The fuel in the fuel rail 18 is pressurised by means of a pump unit 22 which will be described in greater detail by reference to FIGS. 1–3. It is clear from FIG. 1 that the pump unit 22 is mounted in a restricted space being located below an air compressor 24 and a power steering pump 26. Because of the space restrictions, the pump 22 needs to be designed to minimise the external pipework to which it needs to be connected.

The pump unit 22 shown in FIGS. 2 to 5, contains two separate pumps (not shown) within a common housing. The first pump is a low pressure gear pump for drawing fuel from the reservoir or tank, while the second is a high pressure pump for pressurising the fuel rail 18. Such pump units are already known and conventionally each of the two pumps has external inlet and outlet connections. The pumps cannot be connected to one another within the housing because it is necessary to mount a fuel filter between the outlet of the low pressure pump and the inlet of the high pressure pump.

Conventionally, four tubes are therefore needed to establish all the necessary connections to the pump, namely a tube leading from the fuel reservoir to the inlet of the low pressure pump, a filter supply tube leading from the outlet of the low pressure pump to the fuel filter, a filter return tube leading from the filter back to the inlet of the high pressure pump and a high pressure tube leading from the high pressure pump to the common fuel supply rail.

In accordance with the present invention, the need for one of these tubes is eliminated. While it is also possible to eliminate the filter return tube, the illustrated embodiment only eliminates the need for an external tube from the outlet of the low pressure pump to the filter.

Figure 2:
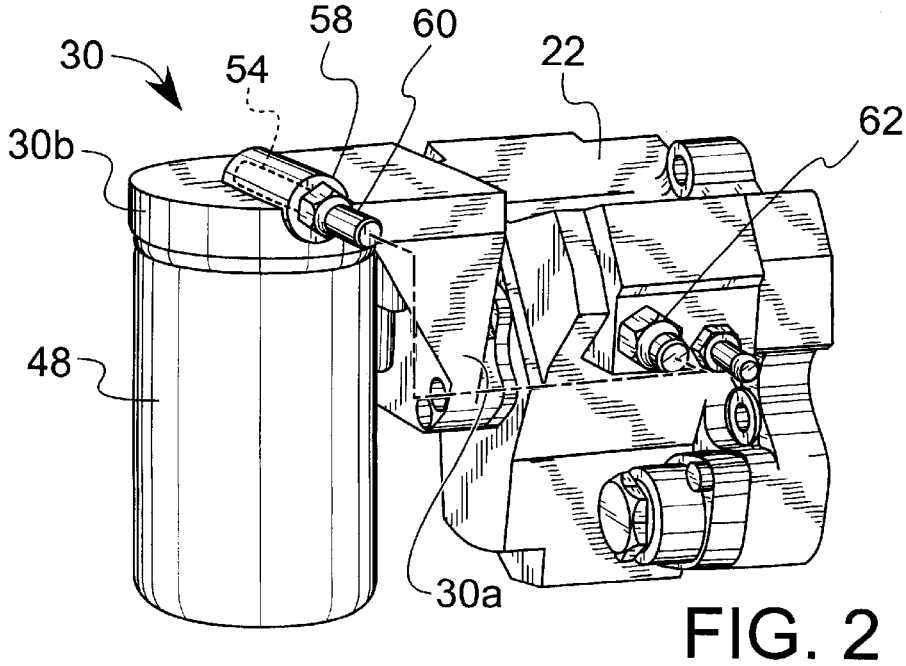
FIG. 2 is a perspective view showing an HPCR pump unit fitted with a filter head.
Figure 3:
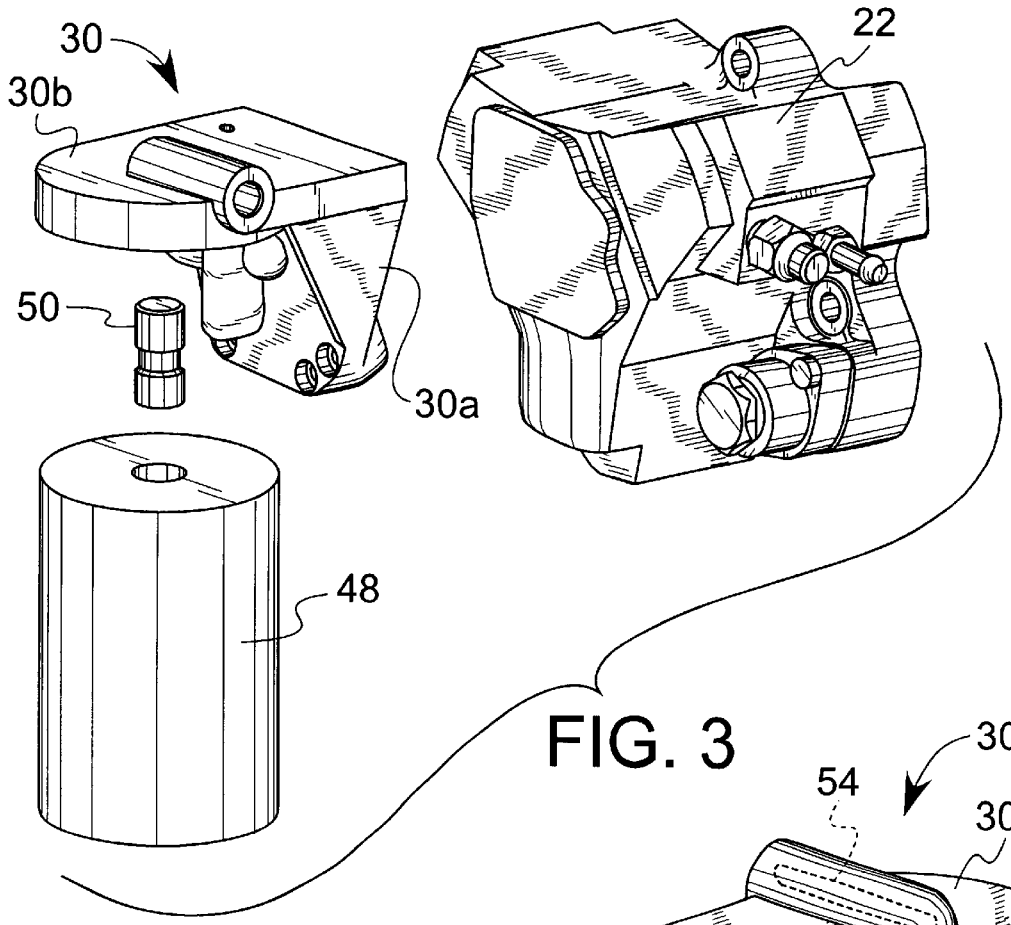
FIG. 3 is a exploded perspective view of the HPCR pump unit and filter head of FIG. 2.
Figure 4:
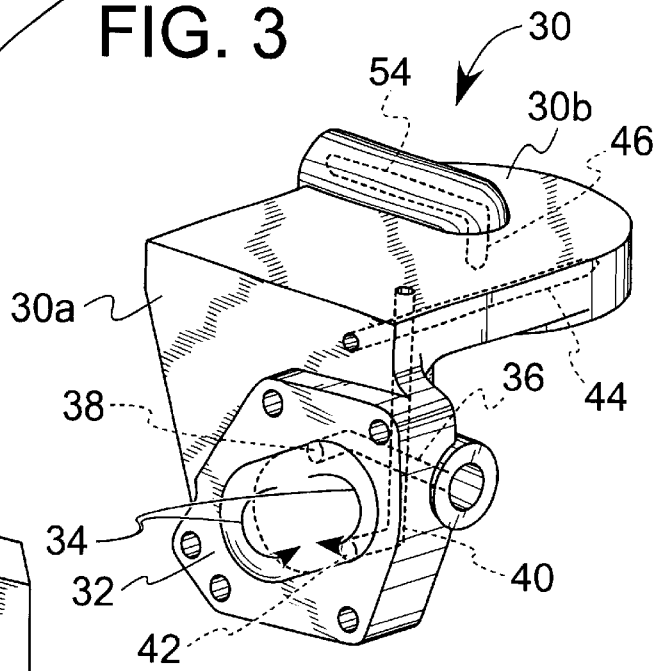
FIG. 4 is a perspective view of the filter head as seen from one side and below, with the fuel flow passages shown in dotted lines.
Figure 5:
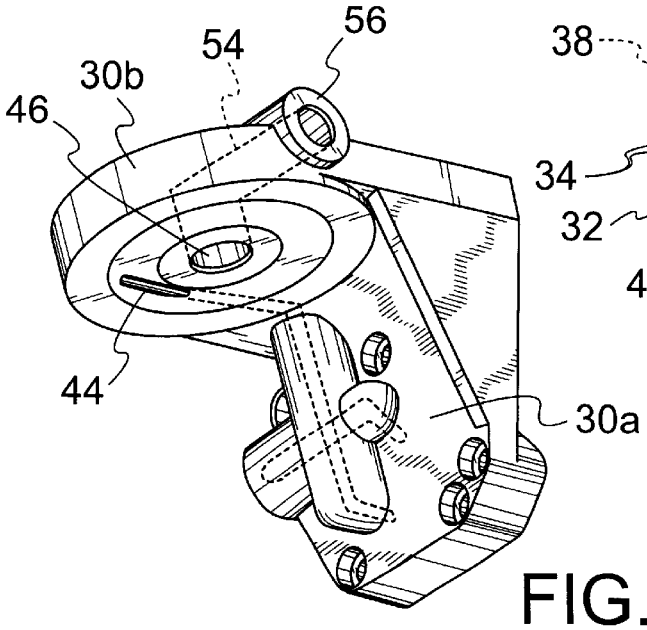
FIG. 5 is a perspective view of the filter head as seen from the other side and below, with the fuel flow passages again shown in dotted lines.

In FIGS. 2 and 3, there is shown a filter head 30 releaseably connected to the pump unit 22. The filter head 30 is generally L-shaped and has a first plate 30*a* bolted to the pump unit 22 and a second plate 30*b* that acts as a filter mounting plate. A disposable filter 48 containing a filtration element (not shown) is fitted by means of a threaded connector 50 to the filter mounting plate 30*b* by way of a threaded central opening 46. If desired, an electrical fuel heater may be fitted between the filter housing 48 and the mounting plate 30*b*.

The high pressure pump is contained within the unit 22. The low pressure pump, on the other hand, has a working chamber 32 recessed into first plate 30*a* of the filter head. Two meshing gears (not shown) are housed within the working chamber 32 and are driven from within the pump unit 22. As the gears rotate in the direction of the arrows 34 in FIG. 4, fuel is drawn through an opening 38 of a passage 36 that leads to a connector (not shown) for the fuel supply tube from the fuel tank.

The fuel pumped by the low pressure gear pump leaves the working chamber 32 through an opening 42 of a passage 40 that leads to an opening 44 in the filter mounting plate 30*b* lying to one side of the filter element in the filter housing 48. After passing radially inward through the cylindrical filter element 48, the filtered fuel leaves through the central opening 46 in the filter mounting plate 30*b* and flows by way of a further passage 54 in the filter mounting plate 30*b* to a opening 56 which receives a connector 58 for the filter return line 60 that conducts the filtered fuel to the inlet 62 of the high pressure pump of the unit 22.

The filter head 30 is formed of an aluminium or other metal casting and the various passages can be conveniently formed within during the casting process. Alternatively, the passages can be machined in the casting and their ends plugged.

It will be clear that if the pump unit is designed such that the inlet to the high pressure pump lies beneath the plate 30*a*, then it would be possible to dispense also with the filter return pipe and replace it by a further passage formed in the casting of the filter head.

It should be mentioned that various other components of the pump unit have been shown in the drawing but they need not be described here in detail as they are incorporated in a commercially available pump unit manufactured by Robert Bosch.

By employing the present invention, the need for at least one external pipe leading to or from the filter is avoided by fitting the filter head directly onto the pump unit or forming it as part of the housing of the pump unit.

It is preferred to form the filter head as part of the housing of the low pressure pump so that the first internal flow passage in the fuel filter head may establish a permanent internal connection between the outlet of the low pressure pump and the filter. It is further preferred for the fuel filter head to constitute one of the walls of the working chamber. In this case, the connection from the filter head to the inlet of the high pressure pump may be made by means of an external pipe but it is alternatively possible to design the HPCR pump unit such that the filter head may also overlie and communicate directly with the inlet of the high pressure pump so as to dispense entirely with external pipework to and from the filter.

It is alternatively possible to arrange for the second flow passage in the fuel filter head to establish a permanent connection with the inlet of the high pressure pump and to provide an external pipe leading from the outlet of the low pressure pump to the filter.

While a preferred embodiment of the present invention has been described, it should be apparent to those skilled in the art that other embodiments may be employed without departing from the spirit and scope thereof.

Have thus described the invention, what is desired to be secured by Letters Patent of the United States is:

1. Apparatus comprising a pump unit incorporating an engine driven low pressure pump for drawing fuel from a reservoir and an engine driven high pressure pump contiguous to said low pressure pump, said high pressure pump being connected to supply fuel drawn by the low pressure fuel pump under pressure to a common fuel rail, and fuel filtering means connected in the fuel flow path between the low pressure and the high pressure pump, said fuel filtering means comprising a fuel filter head connected to the housing of the pump unit and having a first plate comprising a recess forming at least a portion of the wall of a working chamber of the low pressure pump and a second plate extending at generally a right angle with respect to said first for mounting a filter containing a filtration element, the plate mounting the fuel filter being formed with a first internal flow passage connecting with a passage in the second plate extending from said working chamber to enable fuel pressurised by the low pressure pump to be supplied through a permanent connection to one side of the filtration element and a second flow passage connected to the other side of the filter element to enable the filtered fuel to be supplied to the high pressure pump.

2. Apparatus as claimed in claim 1, wherein the connection from the filter head to the inlet of the high pressure pump is effected by means of an external tube.

3. An apparatus as claimed in claim 2, wherein the filter head is formed as a casting.

4. An apparatus as claimed in claim 3, wherein the flow passages are moulded as part of the casting.

5. An apparatus as claimed in claim 4, wherein the casting is made of aluminium.

* * * * *